US006860220B2

(12) United States Patent
Fleming

(10) Patent No.: US 6,860,220 B2
(45) Date of Patent: Mar. 1, 2005

(54) WATERCRAFT AND INFLATABLE FLOORING THEREFOR

(75) Inventor: Timothy Fleming, Paris (FR)

(73) Assignee: Zodiac Hurricane Technologies, Inc., Delta (CA)

( * ) Notice: Subject to any disclaimer, the term of this patent is extended or adjusted under 35 U.S.C. 154(b) by 15 days.

(21) Appl. No.: 10/217,526

(22) Filed: Aug. 13, 2002

(65) Prior Publication Data

US 2004/0031207 A1 Feb. 19, 2004

(51) Int. Cl.[7] ..... B63B 7/08
(52) U.S. Cl. ..... 114/345; 441/40
(58) Field of Search ..... 114/345; 441/40, 441/41, 66

(56) References Cited

U.S. PATENT DOCUMENTS

| | | | | |
|---|---|---|---|---|
| 3,559,222 A | * | 2/1971 | Walker | 114/357 |
| 4,603,651 A | * | 8/1986 | Harding | 114/345 |
| 4,722,292 A | * | 2/1988 | Marino et al. | 114/140 |
| 4,807,555 A | * | 2/1989 | Hart | 114/345 |
| 5,868,095 A | | 2/1999 | Zeromski et al. | |
| 6,164,237 A | | 12/2000 | Coryell et al. | |
| 6,223,678 B1 | | 5/2001 | Haller et al. | |

FOREIGN PATENT DOCUMENTS

| | | | | |
|---|---|---|---|---|
| EP | 0 154 964 A2 | | 9/1985 | |
| GB | 1 293 388 | * | 10/1972 | 114/345 |
| GB | 2 168 932 | * | 7/1986 | 114/345 |
| JP | 2000-25684 | * | 1/2000 | |

OTHER PUBLICATIONS

International Search Report in PCT/IB03/03611

* cited by examiner

*Primary Examiner*—Sherman Basinger
(74) *Attorney, Agent, or Firm*—Dean W. Russell; Kilpatrick Stockton LLP

(57) ABSTRACT

Watercraft flooring including both inflatable and non-inflatable elements is detailed. Such flooring may be designed to support substantial loads while maintaining its lightweight nature and contributing to its longitudinal and lateral rigidity. Some versions of the flooring have an inflatable core with slats positioned both above the upper surface of the core and below the lower surface of the core at regular intervals along its length. The slats extend laterally across substantially the width of the core, effectively sandwiching portions of the core between them.

21 Claims, 6 Drawing Sheets

WATERCRAFT AND INFLATABLE FLOORING THEREFOR

FIELD OF THE INVENTION

This invention relates to watercraft, particularly (although not exclusively) to inflatable watercraft, and to inflatable flooring therefor.

BACKGROUND OF THE INVENTION

U.S. Pat. No. 5,868,095 to Zeromski, et al., incorporated herein in its entirety by this reference, details exemplary inflatable flooring for watercraft such as inflatable boats. Flooring described in the Zeromski patent is denoted as "rigid" and comprises "at least one watertight enclosed chamber of a generally very flat shape and which can be inflated to a relatively high pressure." The chamber is defined (in part) by upper and lower main walls, with each wall being formed of > at least one sheet of at least one flexible and airtight material. In general, each wall is constituted by an assembly of several sheets . . . which each have specific individual compositions and characteristics . . . . The two walls are also connected to each other by a multiplicity of flexible links such as threads, all of approximately the same length, anchored in [the] walls and holding them against the separating force generated by the inflation pressure.

See Zeromski, col 2, 11 29–47 (numerals omitted). Additionally addressed in the Zeromski patent are anti-slip materials for the external face of the upper wall.

U.S. Pat. No. 6,164,237 to Coryell, et al., also incorporated herein in its entirety by this reference, illustrates an inflatable one-man raft with an inflatable "half-floor . . . formed generally at the forward end." The rear end of the raft, by contrast, "is open in a vertical direction to permit the operator's legs to extend downwardly into the water." See Coryell, col. 2, 11 17–20. According to the Coryell patent:

> The half-floor may comprise a plurality of transverse tube sections mounted in edge-to-edge relationship. The transverse tube sections may be mounted to the main floatation member so that the series of transverse tubes generally follow an inclined plane which slopes upwardly towards the rearward end of the craft.

See id., 11. 27–33. Because it is designed to function as the operator's seat rather than as a floor per se, the half-floor of the Coryell patent additionally may include "a generally upright back rest." See id., 1. 43.

Unlike those of the Zeromski patent, many inflatable floors (presumably including the "half-floor" of the Coryell patent) are not sufficiently strong to support significant numbers of persons and equipment, as might be necessary to transport combat troops and military gear, for example. Such floors, although very light and compact when folded, can be punctured relatively easily, reducing their strength and the performance of their corresponding boats. As a consequence, some inflatable (and other) boats utilize rigid, non-inflatable floors. These rigid floors often are made of multiple sections that can be removed from the boat and stacked for packing. Because they are sectioned, however, they must be installed (or reinstalled) following inflation of the boat, slowing deployment.

Yet other flooring presently in use encompasses rigid, foldable ("roll-up") floors. These types of floors, which are not inflated, are typically made of aluminum or wooden slats. To counteract deficiencies in strength and lateral rigidity, the slats are often oversized, resulting in a floor that is heavier and larger than analogous inflatable floors. Further, such roll-up floors frequently are wavy, exhibiting poor longitudinal rigidity in use

SUMMARY OF THE INVENTION

The present invention provides alternate flooring including both inflatable and non-inflatable elements. Utilizing an inflatable core permits the flooring to support substantial loads while maintaining its lightweight nature. Such a high-pressure inflatable core additionally contributes to longitudinal and lateral rigidity of the flooring, avoiding diminished stability associated with some existing floors.

By contrast, including non-inflatable slats in the flooring prevents cambering of the inflatable core and helps protect the core from punctures even when the flooring is subjected to substantial forces. Moreover, even if the core is punctured or otherwise deflates wholly or partially, the non-inflatable slats will provide some residual rigidity, at times adequate to permit accomplishment of the then-current mission. Finally, because normally rigidity is principally provided by the inflatable core, the slats need not be oversize or as numerous as in existing slatted floors. They likewise may be hollow if desired, reducing their overall weight and facilitating roll-up for storage.

Some preferred embodiments of the invention include an inflatable core spanning much or all of the distance between side buoyancy tubes of an inflatable watercraft. Positioned above the upper surface of the core and below the lower surface of the core at regular intervals along its length are hollow slats. These slats extend laterally across substantially the width of the core, effectively sandwiching portions of the core between them. Stringers comprised of brackets and straps additionally may be used to connect pairs of corresponding upper and lower slats. Such brackets preferably (although not necessarily) are formed of aluminum and may be angled to match generally the angles existing between the fabric bottoms and the side buoyancy tubes of certain inflatable boats.

Alternatively, the upper and lower slats may be connected by rigid material or otherwise formed so as to retain their vertical spacing even if the inflatable core deflates. Furthermore, because the slats themselves typically are rigid, accessories (e.g. seats, steering consoles, storage boxes, etc.) may be bolted, directly or indirectly, to them. This avoids required use of the "D"-rings or straps often glued or welded to current inflatable components, although such rings and straps may continue to be used if desired. Finally, the inflatable cores may be designed and sealed so as to provide through holes or passages facilitating access to the bilge area underneath the floor. These holes or passages also allow for hoses, pipes, or other devices to pass through the core without deflating it It thus is an optional, non-exclusive object of the present invention to provide innovative flooring for watercraft.

It is an additional optional, non-exclusive object of the present invention to provide flooring comprising both inflatable and non-inflatable elements.

It is also an optional, non-exclusive object of the present invention to provide lightweight flooring for inflatable watercraft that is designed both to reduce vulnerability to punctures and to enhance its rigidity and stability.

It is another optional, non-exclusive object of the present invention to provide for watercraft a removable floor comprised of an inflatable core and spaced sets of non-inflated slats.

It is, moreover, an optional, non-exclusive object of the present invention to provide flooring including brackets shaped generally to match angles existing between bottoms and interior sides of watercraft.

Other objects, features, and advantages of the present invention will be apparent to those skilled in the art with reference to the remaining text and the drawings of this application.

DETAILED DESCRIPTION

Figure 1:
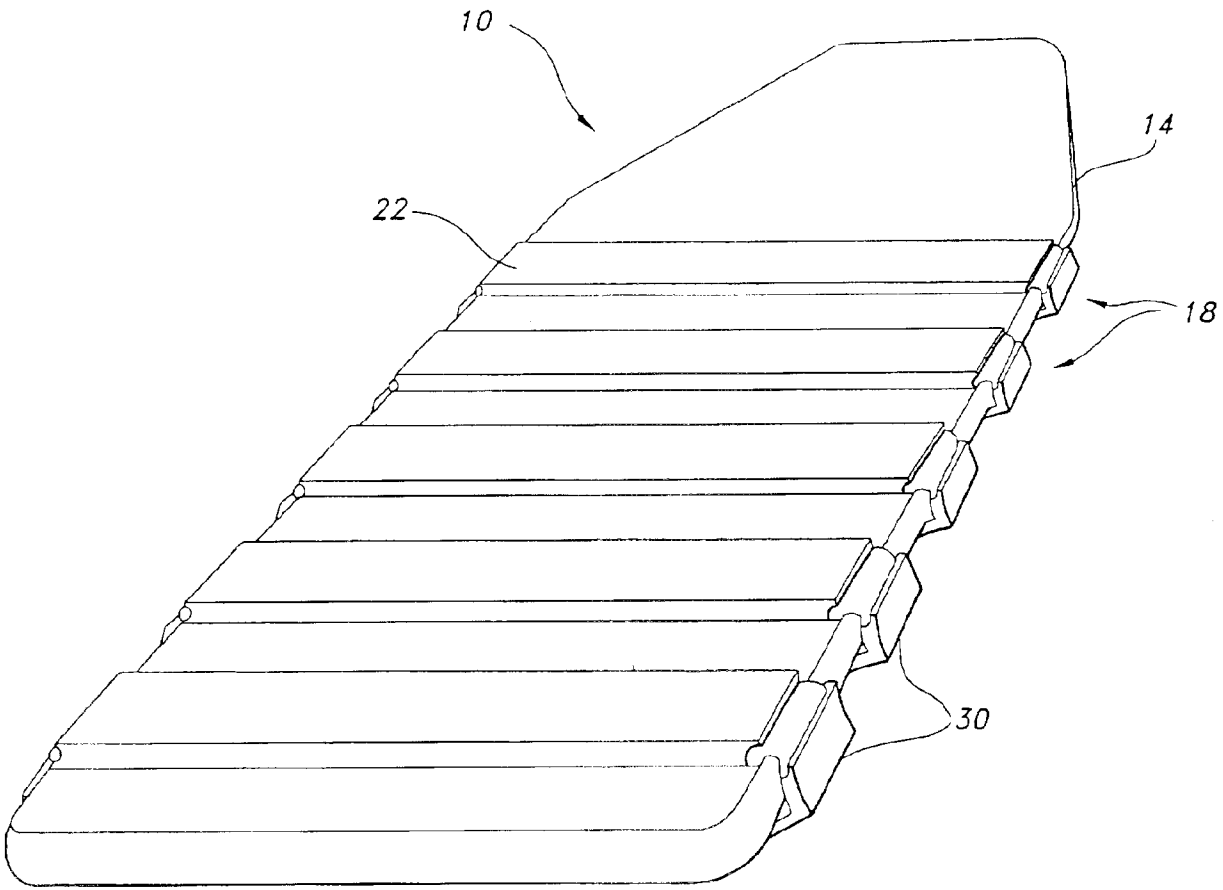
FIG. 1 is a perspective view of exemplary flooring of the present invention shown in an inflated state.
Figure 2:
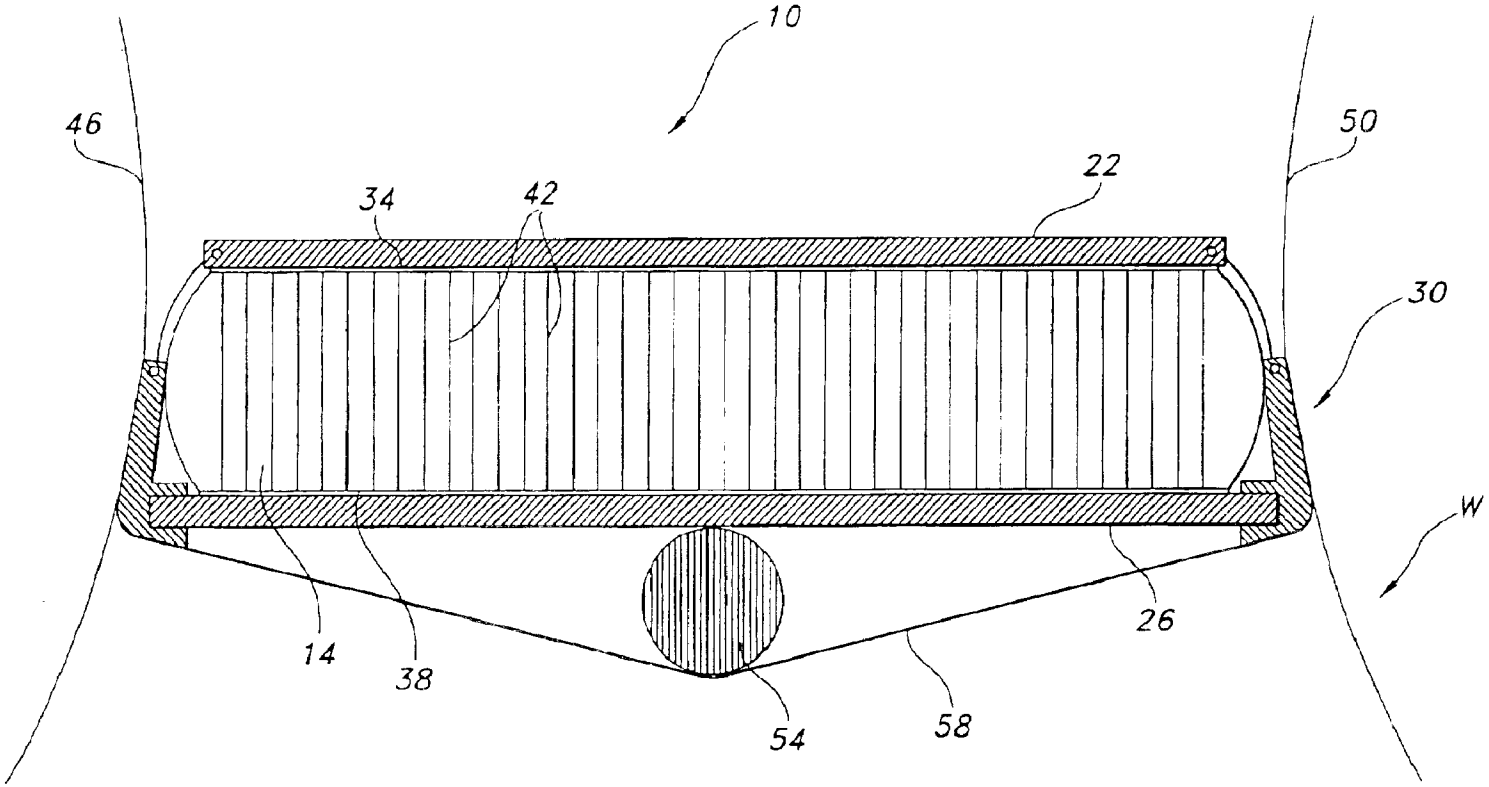
FIG. 2 is a cross-sectional view of the flooring of FIG. 1 illustrating its installation in an inflatable boat.
Figure 3:
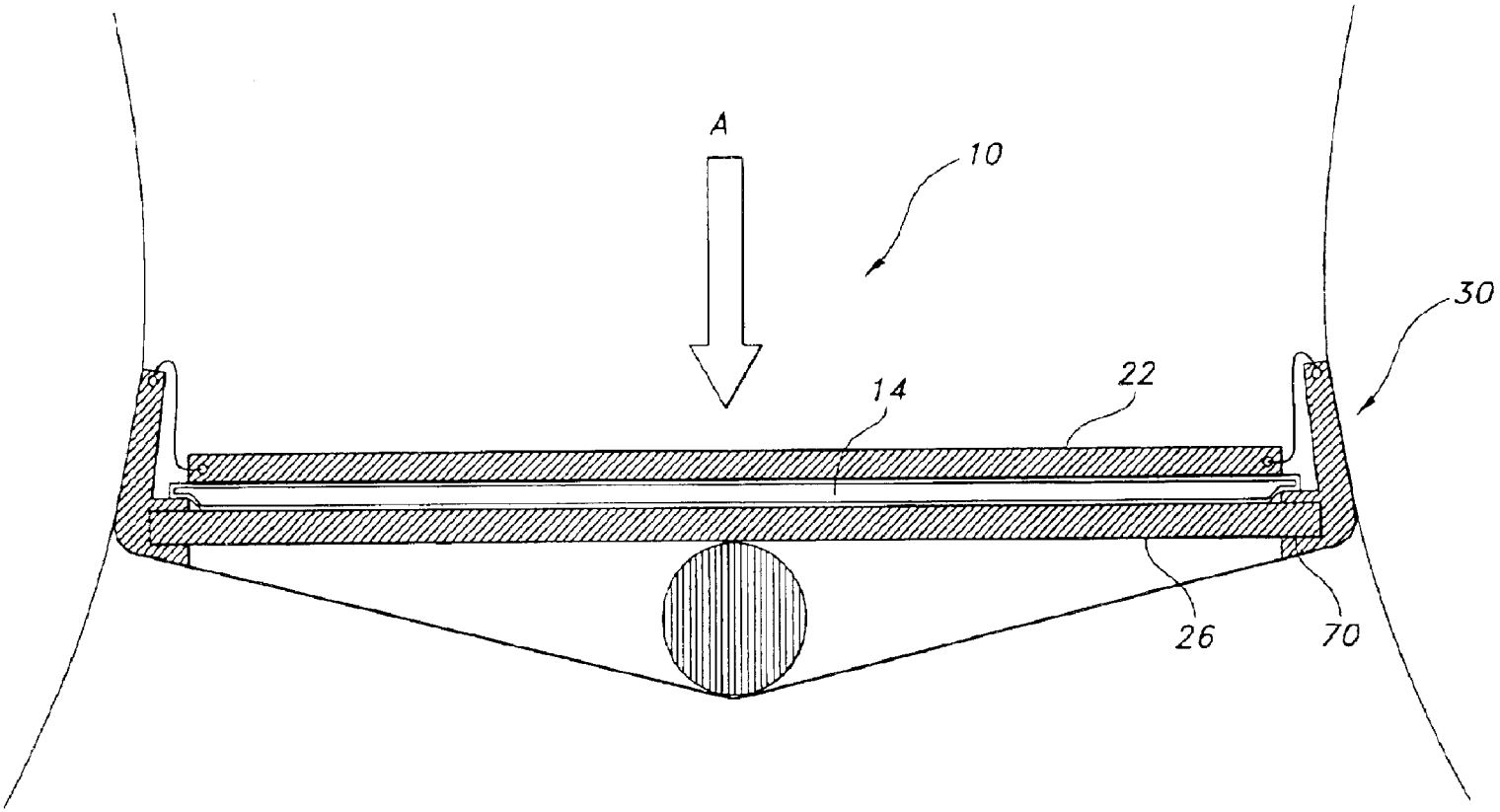
FIG. 3 is a cross-sectional view of the installed flooring of FIG. 2 illustrated in a deflated state.
Figure 4:
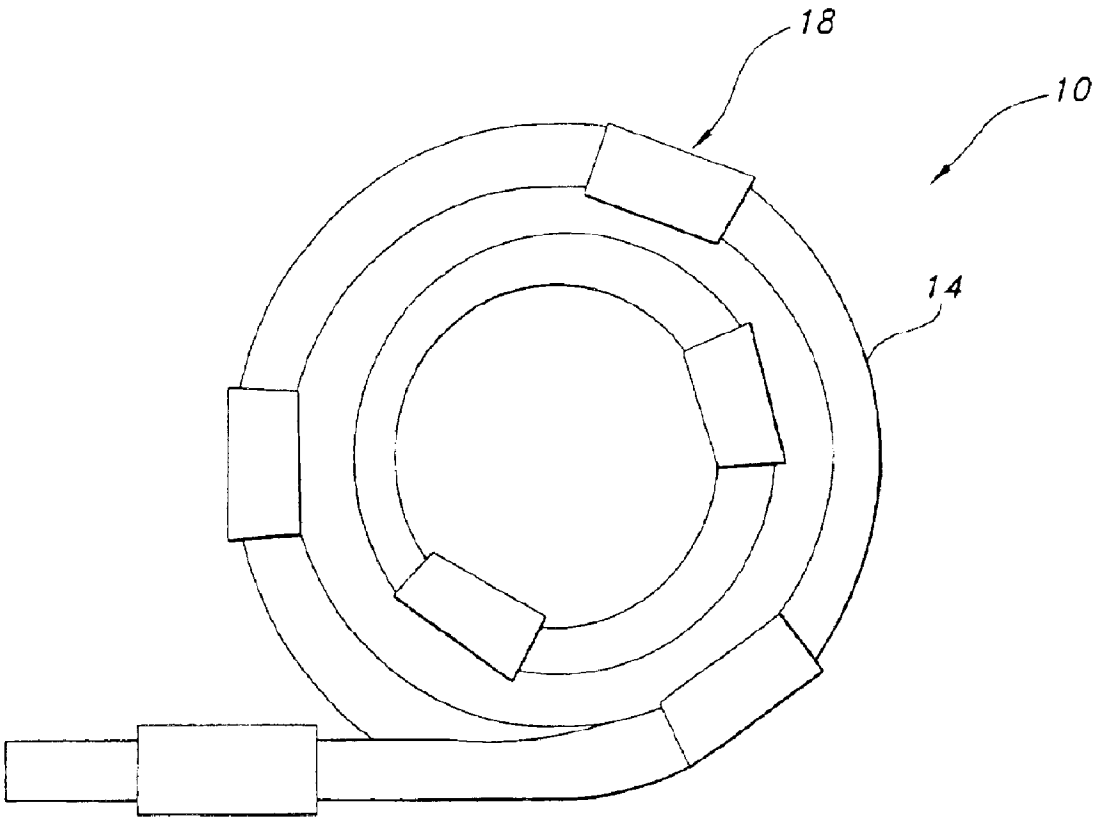
FIG. 4 is a side view of the type of flooring of FIG. 1 shown in a deflated state and rolled-up (as, for example, for storage).

FIGS. 1–4 illustrate exemplary flooring 10 of the present invention. As detailed therein, flooring 10 may comprise core 14, lateral components 18 (comprising sets of upper and lower slats 22 and 26, respectively), and stringers 30. Although FIG. 1 illustrates five such components 18 and FIG. 4 illustrates six, those skilled in the art will recognize that more or fewer such components 18 may be utilized as part of any particular flooring 10. Likewise, although not presently preferred by the applicants, various of upper or lower slats 22 or 26 of the sets, or some or all of stringers 30, may be omitted if desired.

Core 14 preferably is inflatable with air or other gas. Using such a core 14 provides a lightweight way of providing flooring that may support substantial loads. Indeed, embodiments of core 14 may be designed to be inflated to relatively high pressures (on the order of one bar) for use in supporting quantities of troops and equipment being transported over water. Because so inflated, core 14 also may contribute to longitudinal and lateral rigidity of flooring 10.

Typically characterized as being rigid when inflated, core 14 may, for example, be made consistent with the description in the Zeromski patent, hence including upper and lower walls 34 and 38 and multiple flexible links 42 therebetween. Core 14 may, however, be formed differently than as described in the Zeromski patent. Regardless, core 14 preferably includes one or more watertight, inflatable chambers and valves or other mechanisms allowing their inflation.

FIG. 2 details flooring 10 as installed in an exemplary watercraft W for use. Watercraft W, depicted as of the inflatable type, includes side buoyancy tubes 46 and 50 of a generally "U"-shaped buoyancy unit defining a hull. Also shown in FIG. 2 are keel 54 and base 58 of watercraft W. Typically (although not necessarily) made of waterproof fabric, base 58 is intended to span the distance between tubes 46 and 50 and to attach thereto. Consistent with the inflatable boat of the Zeromski patent, keel 54 may itself comprise an inflatable tube positioned centrally within watercraft W intermediate flooring 10 and base 58. As a consequence, base 58 normally assumes a generally "V"-shape when in use. Again, however, either or both of keel 54 and base 58 may differ from the preferred components shown in FIG. 2 or be omitted if appropriate or desired.

Spaced along the length of core 14 are sets of upper and lower slats 22 and 26, with upper slats 22 abutting upper wall 34 and lower slats 26 abutting lower wall 38. In regions adjacent tubes 46 and 50, stringers 30 may be used to connect sets of the upper and lower slats 22 and 26 so that, when core 14 is inflated, tension exists in flooring 10. Doing so may maintain or enhance both the rigidity and the stability of the flooring 10.

Any desired spacing may be used between sets of upper and lower slats 22 and 26. Preferably, the spacing will be uniform (or approximately so) between adjacent sets of slats 22 and 26. Alternatively, the spacing may be non-uniform, or selected slats 22 or 26 may be omitted from any particular set. Nevertheless, slats 22 and 26 typically need not be oversized (because of the general rigidity provided by inflated core 14) and need not be as numerous as in existing slatted floors Each of slats 22 and 26 may be made of metal (advantageously non-corrosive metal), wood, plastic, glass-reinforced polyester, or a composite or laminated material such as (but not necessarily) polyurethane, polyethylene, or other rotomolded materials. Preferably, however, upper and lower slats 22 and 26 are made of aluminum formed into hollow planks. Utilizing hollow aluminum slats permits formation of relatively flat footing surfaces for troops and cargo and provides substantial strength while being lightweight itself. The presence of slats 22 and 26 additionally reduces the likelihood of core 14 being punctured (and inflation consequently lost) should, for example, heavy or sharp objects be thrown into watercraft W, and inhibits core 14 from cambering.

Further, even if core 14 becomes deflated in use, the existence of slats 22 and 26 provides residual rigidity, which in some cases may be adequate to facilitate accomplishment of the then-current mission of watercraft W before the core 14 need be repaired and reinflated. Absent use of slats 22 and 26, by contrast, deflation of core 14 could significantly adversely affect the longitudinal and lateral rigidity of watercraft W itself Because watercraft W may be used with powerful outboard engines, this decrease in rigidity could in turn substantially impact proper performance of the boat, especially at high speed.

FIG. 3 illustrates flooring 10 with core 14 in a (fully) deflated condition while within watercraft 10. Notwithstanding this condition, the periphery of core 14 remains surrounded by lateral components 18 and stringers 30, as the force of gravity (and weight of troops or objects in watercraft W) directs upper slats 22 downward (in the direction of arrow A). Components 18 and stringers 30 thus help maintain proper positioning of core 14 within the watercraft W even when the core 14 is deflated.

Deflating core 14 also facilitates removal of flooring 10 from watercraft W for storage, repair, or otherwise. Depicted in FIG. 4 is such flooring 10 rolled-up for movement apart from watercraft W or for storage. The slim profile and lack of oversizedness of slats 22 and 26 additionally facilitate rolling flooring 10 in the compact fashion illustrated in FIG. 4.

Figure 5:
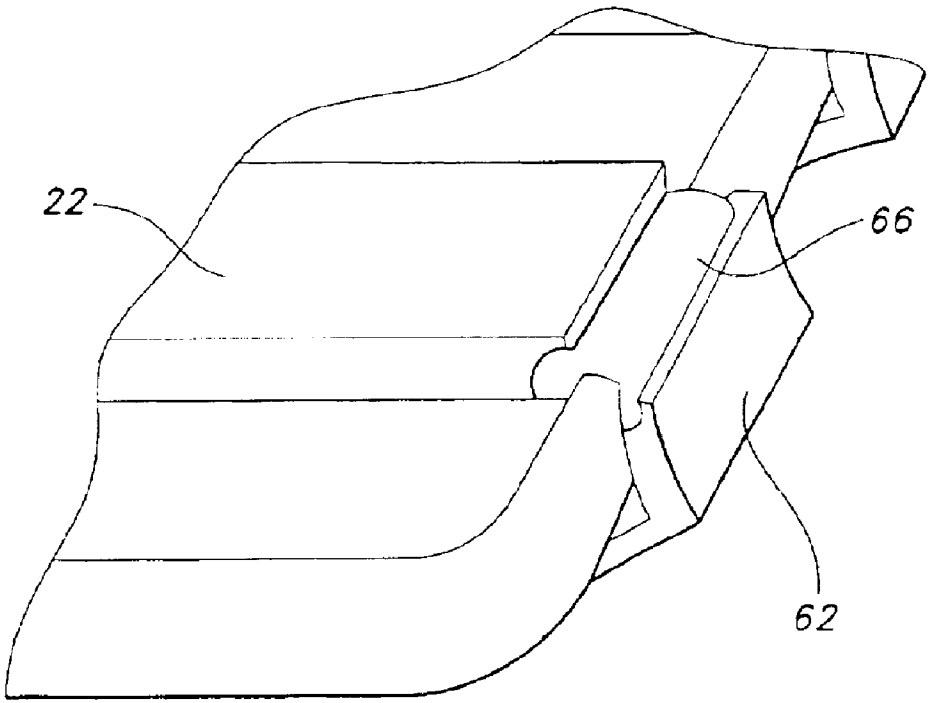
FIG. 5 is a perspective view of an exemplary stringer adapted for use with or as part of the present invention.
Figure 6B:
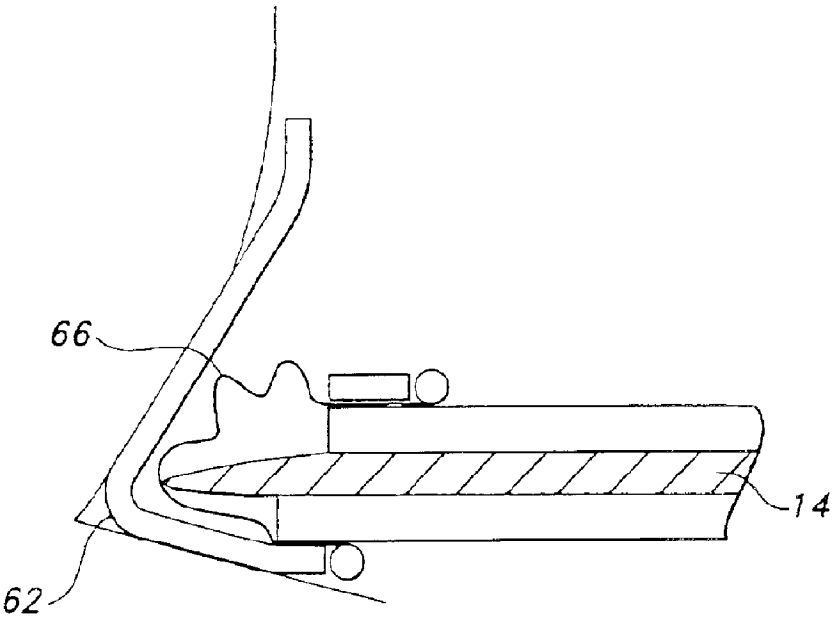
FIGS. 6A–B are cross-sectional views of the stringer of FIG. 5.
Figure 6A:
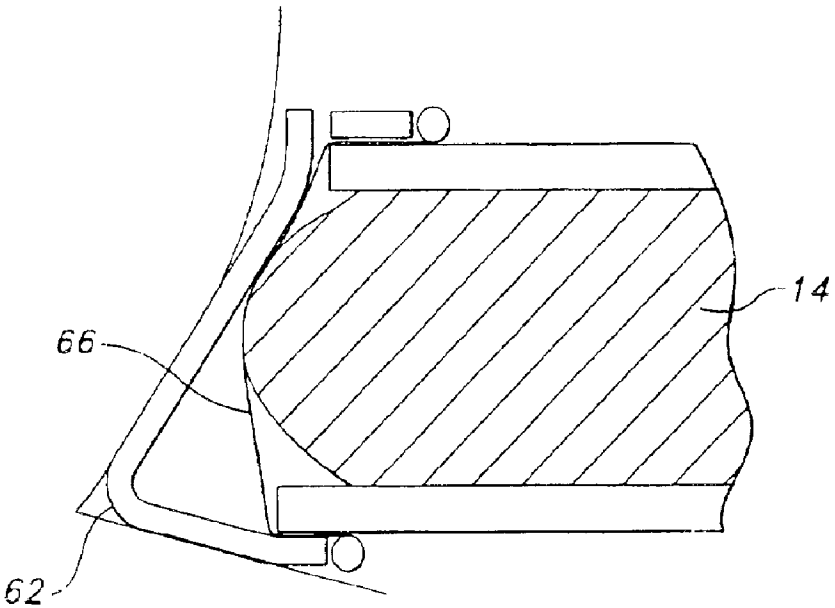

FIGS. 5 and 6A–B present selected views of stringers 30. Each stringer 30 preferably comprises bracket 62 and strap 66, with the latter typically connected at least to an upper slat 22. FIG. 3 further details the possibility of bracket 62 including (optional) notch 70 to receive lower slat 26. Regardless, however, the combination of two stringers 30 and a set of upper and lower slats 22 and 26, as depicted in FIG. 3, will completely surround the periphery of a portion of core 14.

One acceptable material for forming bracket 62 is aluminum, while strap 66 preferably is fabric. Bracket 62 may be shaped (as shown especially in FIGS. 6A–B) to fit the angle made by the attachment of base 58 to either of tube 26 or 30. Doing so increases the ability of flooring 10 to span substantially the entire distance between tubes 26 and 30, as brackets 62 need not protrude significantly from tubes 26 and 30. Those skilled in the art will, however, recognize that stringers 30, if present, need not necessarily be constructed as illustrated in FIGS. 2, 5, or 6A–B.

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention. As non-limiting examples of some of such adaptations, flooring of the present invention additionally may include such features as an anti-slip composition as disclosed in the Zeromski patents or a protective coating or composition for core 14 designed to increase its resistance to punctures. Indeed, in some embodiments of flooring 10, such a puncture-resisting coating or composition could replace some or all of lateral components 18 and stringers 30.

What is claimed is:

1. Inflatable watercraft comprising a hull and flooring associated therewith, the flooring comprising:

a. an inflatable core having an upper surface, a lower surface, and a length;

b. a first slat contacting the upper surface;

c. a second slat contacting the lower surface; and d. a third slat spaced from the first slat along the length of the inflatable core and contacting the upper surface.

2. Inflatable watercraft according to claim 1 in which the first slat is non-inflatable.

3. Inflatable watercraft according to claim 1 in which the first slat is connected to the second slat.

4. Inflatable watercraft according to claim 3 in which the flooring further comprises a stringer connecting the first and second slats.

5. Inflatable watercraft according to claim 4 in which the stringer comprises a bracket and a strap.

6. Inflatable watercraft according to claim 5 in which the bracket is connected to the strap.

7. Inflatable watercraft according to claim 5 in which the bracket contains a notch in which the second slat is fitted.

8. Inflatable watercraft according to claim 3 further comprising a fourth slat (i) contacting the lower surface, (ii) connected to the third slat, and (iii) spaced from the second slat.

9. Inflatable watercraft according to claim 1 in which the hull comprises first and second inflatable tubes, which tubes are spaced along at least part of their lengths.

10. Inflatable watercraft according to claim 9 further comprising:

a. a keel; and b. a base spanning a spaced portion of the first and second tubes.

11. Inflatable watercraft according to claim 10 in which the keel is positioned below the flooring and above the base.

12. Inflatable watercraft according to claim 11 in which the base is made of fabric and the keel is inflatable.

13. Inflatable watercraft according to claim 10 in which (i) the base is connected to the first tube so as to define an angle with the interior surface thereof, (ii) the flooring further comprises a stringer attached to the first stat, and (iii) the stringer comprises a bracket angled to match approximately the angle between the base and the interior surface of the first tube.

14. Inflatable watercraft according to claim 1 in which the first slat is hollow.

15. Inflatable watercraft according to claim 1 in which the core may be deflated and the flooring removed and rolled-up for storage.

16. Watercraft flooring comprising:

a. an inflatable core having an upper surface, a lower surface, and a length;

b. a first slat contacting the upper surface;

c. a second slat spaced from the first slat along the length of the inflatable core and contacting the upper surface; and d. a third slat spaced vertically from the first slat, the first and third slats sandwiching a portion of the core.

17. Watercraft flooring according to claim 16 in which the first and third slats form a first set of components, further comprising a fourth slat which together with the second slat forms a second set of components spaced from the first set of components.

18. Watercraft flooring according to claim 17 in which none of the first, second, third, or fourth slats is inflatable.

19. Watercraft flooring according to claim 16 in which the first slat is rigid.

20. Watercraft flooring according to claim 16 in which the first and third slats are connected.

21. Watercraft flooring according to claim 20 in which the first and third slats are connected so as to retain their vertical spacing even if the inflatable core deflates.

* * * * *